US007056418B2

(12) United States Patent
Andoh et al.

(10) Patent No.: US 7,056,418 B2
(45) Date of Patent: Jun. 6, 2006

(54) COOKING METHOD FOR PULP

(75) Inventors: Tatsuya Andoh, Kawasaki (JP); Junji Tanaka, Kawasaki (JP); Keigo Watanabe, Iwakuni (JP); Yasunori Nanri, Iwakuni (JP); Makoto Nakao, Chiyoda-ku (JP)

(73) Assignees: Kawasaki Kasei Chemicals Ltd., Tokyo (JP); Nippon Paper Industries Co., Ltd., Tokyo (JP)

( * ) Notice: Subject to any disclaimer, the term of this patent is extended or adjusted under 35 U.S.C. 154(b) by 144 days.

(21) Appl. No.: 10/015,704

(22) Filed: Dec. 17, 2001

(65) Prior Publication Data

US 2002/0088576 A1 Jul. 11, 2002

Related U.S. Application Data

(63) Continuation of application No. PCT/JP00/03835, filed on Jun. 13, 2000.

(30) Foreign Application Priority Data

Jun. 15, 1999 (JP) ..... 11-168948

(51) Int. Cl.
*D21C 3/02* (2006.01)
*D21C 3/20* (2006.01)

(52) U.S. Cl. ..... 162/82; 162/17; 162/39; 162/50; 162/72

(58) Field of Classification Search ..... 162/50, 162/72, 82, 90, 17, 19, 25, 26, 70, 76, 29, 162/37–39; 205/494, 554; 423/562, 566.2
See application file for complete search history.

(56) References Cited

U.S. PATENT DOCUMENTS

| | | | | |
|---|---|---|---|---|
| 4,012,280 A | * | 3/1977 | Holton | 162/65 |
| 4,235,666 A | * | 11/1980 | Bourson et al. | 162/72 |
| 4,473,439 A | * | 9/1984 | Wada et al. | 162/72 |
| 4,764,252 A | | 8/1988 | Shin et al. | |
| 5,624,545 A | | 4/1997 | Landfors et al. | |
| 5,871,663 A | | 2/1999 | Turner | |
| 5,972,197 A | | 10/1999 | Andoh et al. | |
| 6,143,130 A | * | 11/2000 | Stigsson et al. | 162/29 |
| 6,264,819 B1 | | 7/2001 | Andoh et al. | |

FOREIGN PATENT DOCUMENTS

| | | | |
|---|---|---|---|
| EP | 0 903 436 | * | 3/1999 |
| JP | 57029690 | | 2/1982 |
| JP | 07-189153 | * | 7/1995 |
| JP | 8218290 | | 8/1996 |
| JP | 11100783 | | 4/1999 |
| WO | WO 95/32331 | | 11/1995 |
| WO | WO 97/41295 | | 11/1997 |
| WO | WO 00/77294 | | 12/2000 |

OTHER PUBLICATIONS

Japanese Patent Application 1995-189153 (HO7-189153) Computer Translation from Japanese Patent Office web site.*
Patent Abstracts of Japan, JP 7-189153, Jul. 25, 1995.
English Translation of International Preliminary Examination Report (Feb. 15, 2002).
WO200077294/pn; Andoh, T; Nakao, M; Sumino, T; Tanaka, J; Watanabe, K; Pulp digestion liquor-improves pulp yield and reduces kappa value for the same amount of alkall addition compared with prior art . . . ; Patent family for WO 00/77294; Dec. 21, 2000.
European Office Action; Sep. 5, 2003.

* cited by examiner

*Primary Examiner*—Eric Hug
(74) *Attorney, Agent, or Firm*—Oblon, Spivak, McClelland, Maier & Neustadt, P.C.

(57) ABSTRACT

A lignocellulose material is cooked by means of an alkaline cooking liquor containing polysulfides in the presence of a quinone-hydroquinone compound, of which the oxidation-reduction potential in the form present during the cooking, which potential is a value calculated as a standard oxidation-reduction potential (Ea) with a hydrogen ion activity of 1, is within a range of from 0.12 to 0.25V to the standard hydrogen electrode potential. It is thereby possible to cook the lignocellulose material with a low Kappa number and in good yield and at the same time, to reduce the amount of the chemical solution used and to reduce the load on a recovery boiler.

37 Claims, No Drawings

COOKING METHOD FOR PULP

BACKGROUND OF THE INVENTION

1. Field of the Invention

The present invention relates to a method for cooking a lignocellulose material, particularly to an effective cooking method for pulp, wherein a polysulfide cooking liquor and a quinone compound are used in combination.

2. Discussion of Background

The principal method for producing chemical pulp which has heretofore been industrially employed, is an alkaline cooking method of a lignocellulose material such as wood chip, whereby a kraft method employing an alkaline cooking liquor comprising sodium hydroxide and sodium sulfide as the main components, has been used in many cases. Further, as one of cooking methods to improve the yield of pulp, a so-called polysulfide cooking method is widely known, wherein cooking is carried out by means of an alkaline cooking liquor containing polysulfides. According to this polysulfide cooking method, polysulfide ions oxidize and stabilize terminal aldehyde groups of cellulose and hemi-cellulose, to prevent a peeling reaction and to suppress a reaction for elution of cellulose and hemi-cellulose, whereby the yield of pulp will be improved. And, in general, the higher the concentration of the polysulfide sulfur in this polysulfide cooking liquor, the higher the cooking effects.

The alkaline cooking liquor containing polysulfides, to be used in the above cooking method, is produced by a method of air oxidation in the presence of a catalyst (for example, JP-B-50-40395, JP-A-61-257238, JP-A-61-259754, JP-A-09-87987). In this method, when usual white liquor is employed, it is possible to obtain an alkaline cooking liquor having a polysulfide sulfur concentration of about 5 g/l (l represents litter, the same applies in this specification) at a reaction rate of about 60% and a selectivity of about 60%. However, during the formation of polysulfides, this method produces thiosulfate ions as a by-product which is ineffective for cooking, whereby it has been difficult to produce an alkaline cooking liquor containing highly concentrated polysulfide sulfur at a high selectivity.

On the other hand, as shown in e.g. JP-B-57-19239, JP-B-53-45404 and JP-A-52-37803, a quinone cooking method is also widely known, wherein cooking is carried out by adding a quinone-hydroquinone compound to an alkaline cooking liquor. The added quinone compound oxidizes and stabilizes the terminal aldehyde groups of cellulose and hemi-cellulose, thereby to prevent a peeling reaction and suppress an elution reaction of cellulose and hemi-cellulose. On the other hand, the quinone compound which has become a hydroquinone type, will act on lignin to reduce and elute the lignin and to become a quinone type itself. Thus, the quinone-hydroquinone compound stabilizes cellulose and hemi-cellulose and accelerates delignification by the oxidation-reduction cycle of itself, whereby even when compared under such a condition that the Kappa number of pulp is the same, it brings about effects to improve the yield and at the same time to reduce the amount of active alkali required for cooking. Here, in this specification, the quinone-hydroquinone compound means both a quinone compound as an oxidation type quinone substance and a hydroquinone compound as a reduction type hydroquinone substance.

In the Journal of Japan Technical Association of Pulp and Paper Industry, Vol. 32, No. 12, p. 713–721 (1978), Nomura et al. disclose that in cooking for kraft pulp employing a cooking liquor comprising sodium hydroxide and sodium sulfide as the main components, which is commonly adopted as a cooking method for pulp, if a quinone compound is employed, of which the oxidation-reduction potential in the form present during the cooking, which potential is a value calculated as a standard oxidation-reduction potential ($E_a$) with a hydrogen ion activity of 1, is from 0.1 to 0.25V to the standard hydrogen electrode potential, it is possible to improve the yield, etc. of pulp, and they disclose that even within this potential range, a quinone compound such as anthraquinone carboxylic acid or anthraquinone dicarboxylic acid having a potential higher than 9,10-anthraquinone (Ea=0.154V) is inferior in the effects, and a quinone compound such as hydroxyanthraquinone having a low potential has larger effects than 9,10-anthraquinone.

Further, as shown in e.g. JP-A-7-189153, a so-called polysulfide-quinone cooking method having the above-mentioned cooking method combined, is also widely known. By this cooking method, the above-described effects appear synergistically. Namely, as effects of the polysulfide-quinone cooking, improvement in the yield of pulp as compared with the same Kappa number and reduction in the amount of active alkali to be used as compared with the same amount of pulp production, can be accomplished over the cases where the respective techniques are separately employed.

However, no research or development has been made on what type of quinone compounds is effective for cooking and for improvement in the yield of pulp or in the required amount of the chemical solutions to be used, in the presence of polysulfides. In the present invention, a research and study have been made on a cooking method relating to such an aspect, and as a result, it has been found that further improvement in the yield of pulp, further reduction in the amount of the chemical solutions to be used, and solution of the problem relating to the load on the recovery boiler, can be accomplished, thus arriving at the present invention.

SUMMARY OF THE INVENTION

The present invention provides a cooking method for pulp, which comprises polysulfide cooking method pulping a lignocellulose material with an alkaline cooking liquor containing polysulfides in the presence of a quinone-hydroquinone compound, wherein the oxidation-reduction potential of the quinone-hydroquinone compound in the form present during the cooking, which potential is a value calculated as a standard oxidation-reduction potential (Ea) with a hydrogen ion activity of 1, is from 0.12 to 0.25V to the standard hydrogen electrode potential.

DETAILED DESCRIPTION OF THE PREFERRED EMBODIMENTS

In the present invention, it is important that in the cooking method for pulping a lignocellulose material with an alkaline cooking liquor containing polysulfides in the presence of a quinone-hydroquinone compound, the oxidation-reduction potential of the quinone-hydroquinone compound in the form present during the cooking, which potential is a value calculated as a standard oxidation-reduction potential (Ea) with a hydrogen ion activity of 1, is made to be from 0.12 to 0.25V to the standard hydrogen electrode potential, According to the present invention, as compared with a kraft cooking method or a cooking method having a kraft cooking combined with either polysulfides or a quinone-hydroquinone compound alone, it is possible to obtain effects to improve the yield and effects to reduce the amount of active alkali to be contained in the alkaline cooking liquor, as compared with the same Kappa number of the obtained pulp. In addition thereto, it is possible to obtain effects to increase the production as the cooking time can be shortened and to obtain a merit such that the cooking effects scarcely deteriorate even when the liquid to wood ratio is increased.

In the present invention, an alkaline cooking liquor containing polysulfides, is employed. By the oxidation action of the polysulfide sulfur contained in the polysulfide cooking liquor, it is possible to accelerate the stabilization of cellulose and hemi-cellulose and to improve the yield of pulp. Here, a polysulfide ion is represented by the general formula $S_x^{2-}$ and may simply be referred to as a polysulfide. The polysulfide sulfur is meant for sulfur having an oxidation number of 0 in sulfur atoms constituting polysulfide ions and sulfur of (x−1) atoms in $S_x^{2-}$. Further, $Na_2S$-state sulfur generally refers to sulfur having oxidation number of −II in the polysulfide ions (sulfur of one atom per $S_x^{2-}$) and sulfide ions. Further, the active alkali is $NaOH+Na_2S$ calculated as a $Na_2O$ concentration.

In the present invention, as the quinone-hydroquinone compound to be used in this polysulfide-quinone cooking method, one having a standard oxidation-reduction potential (Ea) in the form present during the cooking within a range of from 0.12 to 0.25V, is employed. It is more preferred to select one having a standard oxidation-reduction potential within a range of from 0.14 to 0.20V, whereby further improvement in the cooking effects can be obtained. Here, the standard oxidation-reduction potential is a potential represented by a value obtained by converting the oxidation-reduction potential in the form present during the cooking, into a standard oxidation-reduction potential (Ea) with a hydrogen ion activity of 1, against the standard hydrogen electrode potential.

As mentioned above, the Journal of Japan Technical Association of Pulp and Paper Industry, Vol. 32, No. 12, p. 713–721 (1978) discloses that in a kraft pulp cooking employing a cooking liquor comprising sodium hydroxide and sodium sulfide as the main components which is commonly adopted as a cooking method for pulp, if a quinone compound is employed, of which the oxidation-reduction potential in the form present during the cooking, which potential is a value calculated as the standard oxidation-reduction potential (Ea) with a hydrogen ion activity of 1, is from 0.1 to 0.25V to the standard hydrogen electrode potential, it is possible to improve the yield, etc. of pulp, and it further discloses that even within this potential range, a quinone such as anthraquinone carboxylic acid or anthraquinone dicarboxylic acid having a potential higher than 9,10-anthraquinone (Ea=0.154V), is inferior in the effects, and a quinone such as hydroxyanthraquinone having a low potential has larger effects than 9,10-anthraquinone.

However, no substantial research or study has been made on a combination of a quinone compound with the polysulfide cooking. In general, the effects of the quinone compound are such that as mentioned above, the quinone compound oxidizes and stabilizes the terminal aldehyde groups of cellulose and hemi-cellulose, whereby the peeling reaction is prevented to suppress the reaction for elution of cellulose and hemi-cellulose. On the other hand, the quinone compound which has become a hydroquinone type acts on lignin to reduce and elute the lignin and becomes a quinone type itself. Thus, the quinone-hydroquinone compound has effects to stabilize cellulose and hemi-cellulose and to accelerate delignification by the oxidation-reduction cycle of itself. If polysulfide ions are added thereto, the polysulfide ions have effects to oxidize and stabilize the terminal aldehyde groups of cellulose and hemi-cellulose, whereby the quinone capable of effectively promoting delignification is believed to be more effective.

Namely, in a so-called polysulfide-quinone cooking method, a quinone-hydroquinone compound having a large reduction power is advantageous. It is easily assumed that oxidation and stabilization of cellulose and hemi-cellulose are thereby accelerated, and the range of the standard oxidation-reduction potential of the quinone compound to further improve the cooking effects will shift to a range lower than from 0.1 to 0.25V.

However, as a result of experiments conducted by the present inventors on polysulfide cooking employing quinone-hydroquinone compounds having various standard oxidation-reduction potentials, it has been found, as totally contrast to the above assumption, that if the standard oxidation-reduction potential is lower than 0.12V, no substantial cooking effects will appear. Namely, by many experiments, it has been made clear that if the standard oxidation-reduction potential of the quinone-hydroquinone compound becomes lower than 0.12V, the effects to improve the yield of pulp and effects to reduce the amount of the active alkali to be used, tend to decrease, and if the standard oxidation-reduction potential exceeds 0.25V, the effects to improve the yield of pulp and the effects to reduce the amount of the active alkali to be used, tend to decrease. The value is more preferably within a range of from 0.14V to 0.20V. The present invention is applicable not only to a usual kraft method but also all cooking methods for pulp, including a modified kraft method (MCC method) and a Lo-Solids (registered trademark) method.

In the present invention, the quinone-hydroquinone compound, of which the oxidation-reduction potential in the form present during the cooking, which potential is a value calculated as a standard oxidation-reduction potential (Ea) with a hydrogen ion activity of 1, is from 0.12 to 0.25V to the standard hydrogen electrode potential, may specifically be, for example, an alkyl anthraquinone such as 1-ethyl-9,10-anthraquinone (Ea=0.140V), 9,10-anthraquinone (Ea=0.154V) or 2-methyl-9,10-anthraquinone (Ea=0.150V), a quinone compound such as 1-hydroxy-9,10-anthraquinone (Ea=0.140V), 2-(9,10-anthraquinoyl)-1-ethanesulfonic acid (Ea=0.162V), 9,10-anthraquinone-2-sulfonic acid (Ea=0.187V), 9,10-anthraquinone-2-carboxylic acid (Ea=0.213V), 9,10-anthraquinone-2,7-disulfonic acid (Ea=0.228V), benz(α)anthracene-7,12-dion (Ea=0.228V), 1,4,4a,9a-tetrahydro-9,10-anthraquinone (Ea=0.154V) or 1,4-dihydro-9,10-anthraquinone (Ea=0.154V), and hydroquinone compounds as reduction products thereof.

These standard oxidation-reduction potentials Ea are taken from or in accordance with "Dai Yukikagaku Bekkan 2, Yukikagaku Josu Binran", published by Asakura Shoten, p. 670–680 (1963). The oxidation-reduction potentials of these quinone compounds can be measured by e.g. a usual method employing a cyclic voltammetry, but taking into an error by a measuring apparatus or a measuring person, it is necessary to calculate the measured value by using as a standard, an anthraquinone of which the potential is known, such as 9,10-anthraquinone.

When such a quinone compound is added, it may be an oxidation type quinone substance or a reduction type hydroquinone substance. Irrespective of the state at the time of the addition, it is only required that the quinone-hydroquinone compound in the form present at the time of the cooking is within the above-mentioned potential range. For example, 1,4,4a,9a-tetrahydro-9,10-anthraquinone is present in the form of a disodium salt of 1,4-dihydro-9,10-dihydroxyanthracene in an alkaline cooking liquor. This will be readily oxidized at the initial stage of the cooking to 1,4-dihydro-9,10-anthraquinone, which is further readily transferred to 9,10-anthrahydroquinone, and during the cooking, it is acting in the form of 9,10-anthraquinone and 9,10-anthrahydroquinone. The same applies to 1,4-dihydro-9,10-anthraquinone.

In the present invention, the higher the polysulfide sulfur contained in the polysulfide cooking liquor, the higher the cooking effects. Accordingly, it is preferred to prepare the liquor so that the concentration of the polysulfide sulfur contained in the polysulfide cooking liquor becomes to be at least 6 g/l, more preferably at least 8 g/l.

In the present invention, as a method for producing the polysulfide cooking liquor, it is possible to employ a conventional air oxidation method. However, when a polysulfide cooking liquor containing polysulfide sulfur is produced by the air oxidation method, formation of sodium thiosulfate as a by-product tends to be large, such being disadvantageous. Accordingly, it is preferred to employ a method of electrically oxidizing an alkaline solution containing sulfide ions, i.e. to form the cooking liquor by electrolysis. By such a method, it is possible to produce a polysulfide cooking liquor having a high concentration of a level of at least 8 g/l at a high selectivity. As such an electrolytic method, an electrolytic method of e.g. PCT/JP97/01456, JP-A-10-166374, JP-A-11-51016 or JP-A-11-51033 which has previously been developed by the present inventors, may be employed.

As the electrolytic cell to be used for the electrolytic method, a two compartment type electrolytic cell comprising one anode compartment and one cathode compartment, is required, or one having three or more compartments combined, may be employed. A plurality of electrolytic cells may be arranged to have a monopolar structure or a bipolar structure. To the anode compartment, an alkaline solution containing sulfide ions is introduced, and some sulfide ions are oxidized to form polysulfide ions. And, alkali metal ions will be transferred through a diaphragm to the cathode compartment.

On the other hand, into the cathode compartment, water or a solution comprising water and an alkali metal hydroxide, is introduced, so that the reaction for forming hydrogen gas from water, is preferably utilized. As a result, from the formed hydroxide ions and alkali metal ions transferred from the anode compartment, an alkali metal hydroxide will be formed. The concentration of the alkali metal hydroxide in the cathode compartment is, for example, from 1 to 15 mol/l, preferably from 2 to 5 mol/l. The anode disposed in the anode compartment of the electrolytic cell is preferably such that the entirety of the anode or at least the surface portion thereof, is made of a material excellent in alkali resistance. For example, nickel, titanium, carbon or platinum has practically adequate durability in the production of polysulfides. With respect to the structure of the anode, it is preferred to use a porous anode which is porous and has a three dimensional network structure. Specifically, a foam or an aggregate of fibers may, for example, be mentioned. Such a porous anode has a large surface area, whereby the desired electrolytic reaction takes place over the entire surface of the electrode surface, and formation of a by-product can be suppressed.

The surface area of the anode to be used for the electrolytic method, is preferably from 2 to 100 $m^2/m^2$ in the case where the anode is a foam and from 30 to 5,000 $m^2/m^2$ in a case where the anode is an aggregate of fibers, per unit area of the diaphragm partitioning the anode compartment and the cathode compartment. More preferably, it is from 5 to 50 $m^2/m^2$ and 70 to 1,000 $m^2/m^2$, respectively. If the surface area is to small, the current density at the anode surface tends to be large, whereby not only a by-product such as thiosulfate ions is likely to form, but also dissolution of the anode is likely to take place, such being undesirable. If the surface area is made to be too large, there will be a problem from the viewpoint of electrolytic operation such that the pressure loss of the liquid tends to be large, such being undesirable.

The average pore diameter of the network of the foam anode to be used for the electrolytic method is preferably from 0.1 to 5 mm. If the average pore diameter of the network is larger than 5 mm, the surface area of the anode can hardly be made large, whereby the current density at the anode surface tends to be large, and a by-product such as thiosulfate ions is likely to form, such being undesirable. If the average pore diameter of the network is smaller than 0.1 mm, there will be a problem from the viewpoint of electrolytic operation such that the pressure loss of the liquid tends to be large, such being undesirable. The average pore diameter of the network of the anode is more preferably from 0.2 to 2 mm.

With respect to the porous anode to be used for the electrolytic method, the diameter of the net constituting the network is preferably from 0.01 to 2 mm in the case of a foam and from 1 to 300 μm in the case of an aggregate of fibers. If the diameter is lower than the respective ranges, the production is very difficult and costly, and besides, handing will be difficult, such being undesirable. If the diameter exceeds the respective ranges, it is difficult to obtain an anode having a large surface area, whereby the current density at the anode surface will be large, and a by-product such as thiosulfate ions is likely to form, such being undesirable. Particularly preferably, the diameter is from 0.02 to 1 mm and from 5 to 50 μm, respectively.

The anode in the electrolytic cell may be disposed fully in the anode compartment so that it is in contact with the diaphragm. Otherwise, it may be disposed so that there will be a some space between the anode and the diaphragm. It is required that the liquid to be treated, flows in the anode, and accordingly, it is preferred that the anode has a sufficient porosity. In any case, the porosity of the anode is preferably from 90 to 99% in the case of a foam and from 70 to 99% in the case of an aggregate of fibers. If the porosity is too low, the pressure loss increases, such being undesirable. If the porosity exceeds 99%, it tends to be difficult to increase the surface area of the anode, such being undesirable. The porosity is more preferably from 90 to 98% and from 80 to 95%, respectively.

With respect to the cathode to be used for the electrolytic method, the material is preferably an alkali resistant material, and nickel, Raney Nickel, nickel sulfide, steel or stainless steel may, for example, be employed. The shape may be a flat plate or meshed shape, and one or more may be employed in a multi-layer structure. A three dimensional electrode having a linear electrode combined, may also be employed.

As the diaphragm partitioning the anode compartment and the cathode compartment, to be used in the electrolytic method, it is preferred to employ a cation exchange membrane. The cation exchange membrane introduces cations from the anode compartment to the cathode compartment but prevents transfer of sulfide ions and polysulfide ions. As such a cation exchange membrane, a polymer membrane having cation exchange groups such as sulfonic groups or carboxylic groups introduced to a polymer of a hydrocarbon type or a fluorine type, is preferred. Further, a bipolar membrane or an anion exchange membrane may also be used if there is no problem with respect to the alkali resistance, etc.

In the electrolytic method, the operation is preferably carried out at a current density of from 0.5 to 20 $kA/m^2$ at the diaphragm surface. If the current density is less than 0.5 $kA/m^2$, an unnecessarily large electrolytic installation will be required, such being undesirable. If the current density at the diaphragm surface exceeds 20 $kA/m^2$, by-products such as thiosulfate, sulfuric acid and oxygen, may increase, such being undesirable. The current density at the diaphragm surface is more preferably from 2 to 15 $kA/m^2$. In the present electrolytic method, an anode having a large surface area to the area of the diaphragm, is employed, whereby operation can be carried out within a small range of the current density at the anode surface.

In the electrolytic method, the average superficial velocity in the anode compartment is preferably from 1 to 30 cm/sec. in the case of a foam and from 0.1 to 30 cm/sec. in the case of an aggregate of fibers. If the average superficial velocity is too small, the anode solution in the anode compartment will not be adequately stirred, and in some cases, precipitates are likely to deposit on the diaphragm facing the anode compartment, whereby the cell voltage is likely to increase as the time passes. Further, if it is larger than 30 cm/sec., the pressure loss will increase, such being undesirable. The flow rate of the cathode solution is not particularly limited, but is determined by the degree of buoyancy of the generated gas. The temperature of the anode compartment is preferably from 70 to 110° C. If the temperature of the anode compartment is lower than 70° C., not only the cell voltage becomes high, but also dissolution of the anode or formation of by-products are likely to result, such being undesirable. The upper limit of the temperature is practically limited by the material of the diaphragm or the electrolytic cell. The solution containing sulfide ions to be introduced into the anode compartment is usually treated by one path or by recycling.

In the present invention, as a raw material for an alkaline cooking liquor containing polysulfides to be produced by the electrolytic method, it is preferred to employ white liquor or green liquor which is used at a pulp mill. In the case of white liquor currently employed for kraft pulp cooking, the composition of the white liquor usually contains from 2 to 6 mol/l of alkali metal ions, and at least 90% thereof is sodium ions, the rest being substantially potassium ions. Further, the anions include hydroxide ions, sulfide ions and carbonate ions as the main components, and the sulfide ion concentration is usually from 0.5 to 0.8 mol/l. Further, it contains sulfate ions, thiosulfate ions, chlorine ions and sulfite ions. Further, it contains trace amount components such as calcium, silicon, aluminum, phosphorus, magnesium, copper, manganese and iron. The composition of green liquor is basically the same as white liquor. However, while the white liquor contains sodium sulfide and sodium hydroxide as the main components, the green liquor contains sodium sulfide and sodium carbonate as the main components. In the electrolytic method, a part of sulfide ions in such white liquor or green liquor is oxidized in the anode compartment to form polysulfide ions, which will be supplied to the cooking step.

In the present invention, the $Na_2S$-state sulfur concentration in the alkaline cooking liquor containing polysulfides is preferably at least 10 g/l as calculated as $Na_2O$. If this concentration is less than 10 g/l, the highly concentrated polysulfide sulfur of at least 8 g/l tends to be unstable, and the Kappa number of the pulp obtained by cooking tends to increase, and the yield of pulp is likely to deteriorate.

In the present invention, the quinone-hydroquinone compound is preferably added to the alkaline-cooking liquor so that it will be from 0.01 to 1.5 wt % based on the bone-dry chip. More preferably it is from 0.02 to 0.06 wt %. If the addition of the quinone compound is less than 0.01 wt %, the amount is too small, whereby the Kappa number of the pulp after cooking will not be reduced, and the relation between the Kappa number and the yield of pulp will not be improved. Further, even if the quinone compound is added beyond 1.5 wt %, no further reduction of the Kappa number of pulp after cooking or no further improvement of the relation between the Kappa number and the yield of pulp can be observed.

In the present invention, with respect to the timing for the addition of the quinone compound, a method of adding it all at once before cooking or during cooking, or a method of adding it stepwisely in a divided fashion, is effective. However, it is preferred to add it so that the alkaline cooking liquor containing the quinone compound will sufficiently penetrate into the chip.

Further, in the present invention, the liquid to wood ratio during the cooking is preferably adjusted to be from 1.5 to 5.0 l/kg based on bone-dry chip. Particularly when soft wood chip is employed as the lignocellulose material, the liquid to wood ratio is more preferably from 1.5 to 3.5 l/kg, and when hard wood chip is employed, it is more preferably from 2.5 to 5.0 l/kg. If the liquid to wood ratio is less than 1.5 l/kg, the alkaline cooking liquor may not sufficiently penetrate into the chip, whereby the cooking effects are likely to deteriorate, such being undesirable. If the liquid to wood ratio exceeds 5.0 l/kg, the effects to reduce the amount of the chemical solutions to be used tend to be low, such being undesirable.

Here, the liquid to wood ratio means the amount of the liquid based on the weight of bone-dry chip in the case of a batch system digester, and it means the ratio of the amount by volume of the liquid flowing into the digester to the amount by weight of bone-dry chip flowing into the digester, per unit time, in the case of a continuous system digester.

As the lignocellulose material to be used in the present invention, soft wood or hard wood chip may be used, and any type of tree may be employed. For example, the soft wood may, for example, be Cryptomeria (Japan cedar), Picea (Yezo spruce, Hondo spruce, Norway spruce, Sitka spruce, etc.), Pinus (Monterey pine, Japanese red pine, Japanese black pine, etc.), Thuja (Western red cedar, Japanese arbovitae, etc.) or Tsuga (Japanese hemlock, Western hemlock, etc.), and the hard wood may, for example, be Eucalyptus (eucalyptus trees), Fagus (beech trees), Quercus (oak, white oak, etc.) or Acacia (acacia trees).

EXAMPLES

Now, the present invention will be described in detail with reference to Examples, but the present invention is by no means restricted by such specific Examples. Test methods were as follows.

Test Methods

With respect to the yield of pulp of obtained unbleached pulp, the yield of cleaned pulp having lump removed, was measured. The Kappa number of the unbleached pulp was determined in accordance with TAPPI test method T236hm–85. The quantitative analyses of sodium thiosulfate, $Na_2S$-state sulfur and polysulfide sulfur concentration calculated as sulfur, in the alkaline cooking liquor, were carried out in accordance with the method disclosed in JP-A-7-92148.

Example 1

(1) Preparation of a polysulfide cooking liquor

A two compartment electrolytic cell was assembled, which comprised a nickel plate as an anode current collector, a nickel foam as an anode (100 mm×20 mm×4 mm, average pore diameter of network: 0.51 mm, surface area of the anode per volume of the anode compartment: 5,600 $m^2/m^3$, surface area to the diaphragm area: 28 $m^2/m^2$), an iron expansion metal as a cathode and a fluororesin type cation exchange membrane as a diaphragm. The anode compartment had a height of 100 mm, a width of 20 mm and a thickness of 4 mm, and the cathode compartment had a height of 100 mm, a width of 20 mm and a thickness of 5 mm. The effective area of the diaphragm was 20 $cm^2$. Using model white liquor, circulation electrolysis was carried out at an anode solution linear velocity of 4 cm/sec. at a current density of 6 $kA/m^2$ at an electrolysis temperature of 90° C., whereby a polysulfide cooking liquor having the following composition was obtained at a selectivity of 97%.

Sodium hydroxide: 85.5 g/l (calculated as $Na_2O$)
$Na_2S$-state sulfur: 12.0 g/l (calculated as $Na_2O$)
Sodium carbonate: 15 g/l (calculated as $Na_2O$)
Sodium thiosulfate: 0.5 g/l (calculated as $Na_2O$)
Polysulfide sulfur: 9.0 g/l (calculated as sulfur)

(2) Cooking test

As a lignocellulose material, 25 g of Japanese red pine chip (25 g by bone-dry weight) was used, and the above-mentioned polysulfide cooking liquor was added thereto so that the addition of active alkali would be 16 and 18 wt % (based on the bone-dry chip; calculated as $Na_2O$). The liquid to wood ratio was adjusted to be 2.7 l/kg based on the bone-dry chip, including the moisture brought in by the chip and distilled water added as the case requires. Cooking was carried out under such conditions that 9,10-anthraquinone (Ea=0.154V) as a quinone compound was added to the polysulfide cooking liquor so that it would be 0.05 wt % based on the bone-dry chip, the temperature was raised from 109° C. to 170° C. for 60 minutes, and the maximum temperature was maintained for 73 minutes. The results of the cooking are shown in Table 1. As compared with Comparative Examples 1 and 2, the Kappa number at the same active alkali addition decreased, and the yield of pulp at the same Kappa number increased.

Example 2

Cooking was carried out in the same manner as in Example 1 except that as a quinone compound, tetrahydroanthraquinone (disodium 1,4-dihydro-9,10-dihydroxyanthracene, SAQ, trade name, manufactured by Kawasaki Kasei Chemicals Ltd.) (Ea=0.154V) was added so that it would be the same molar amount as in Example 1. The results of the cooking are shown in Table 1. Like in Example 1, as compared with Comparative Examples 1 and 2, the Kappa number at the same active alkali addition decreased, and the yield of pulp at the same Kappa number increased.

Example 3

Cooking was carried out in the same manner as in Example 1 except that as a quinone compound, 2-methyl-9,10-anthraquinone (Ea=0.154V) was added so that it would be the same molar amount as in Example 1. The results of the cooking are shown in Table 1. Like in Example 1, as compared with Comparative Examples 1 and 2, the Kappa number at the same active alkali addition decreased, and the yield of pulp at the same Kappa number increased.

Example 4

Cooking was carried out in the same manner as in Example 1 except that as a quinone compound, sodium 9,10-anthraquinone-2-sulfonate (Ea=0.187V) was added so that it would be the same molar amount as in Example 1. The results of the cooking are shown in Table 1. Like in Example 1, as compared with Comparative Examples 1 and 2, the Kappa number at the same active alkali addition decreased, and the yield of pulp at the same Kappa number increased.

Example 5

Cooking was carried out in the same manner as in Example 1 except that as a quinone compound, 1-hydroxy-9,10-anthraquinone (Ea=0.125V) was added so that it would be the same molar amount as in Example 1. The results of the cooking are shown in Table 1. Like in Example 1, as compared with Comparative Examples 1 and 2, the Kappa number at the same active alkali addition decreased, and the yield of pulp at the same Kappa number increased.

Example 6

Cooking was carried out in the same manner as in Example 1 except that as a quinone compound, disodium 9,10-anthraquinone-2,7-disulfonate (Ea=0.228V) was added so that it would be the same molar amount as in Example 1. The results of the cooking are shown in Table 1. Like in Example 1, as compared with the Comparative Examples 1 and 2, the Kappa number at the same active alkali addition decreased, and the yield of pulp at the same Kappa number increased.

Comparative Example 1

Cooking was carried out in the same manner as in Example 1 except that the quinone compound or the like was not added. The results of the cooking are shown in Table 1.

Comparative Example 2

Cooking was carried out in the same manner as in Example 1 except that as a quinone compound, 1,2-dihydroxy-9,10-anthraquinone (Ea=0.107V) was added so that it would be the same molar amount as in Example 1. The results of the cooking are shown in Table 1.

Example 7

Cooking was carried out under the following conditions. Cooking was carried out in the same manner as in Example 1 except that as a lignocellulose material, 35 g of beech chip (as bone-dry) was used. As a quinone compound, 9,10-anthraquinone (Ea=0.154V) was added to the polysulfide cooking liquor before raising the temperature in an amount of 0.05 wt % based on the bone-dry chip. The results of the cooking are shown in Table 2. As compared with Comparative Examples 3 and 4, the Kappa number at the same active alkali addition decreased, and the yield of pulp at the same Kappa number increased.

Example 8

Cooking was carried out in the same manner as in Example 7 except that as a quinone compound, tetrahydroanthraquinone (disodium 1,4-dihydro-9,10-dihydroxyanthracene, SAQ, trade name, manufactured by Kawasaki Kasei Chemicals Ltd.)(Ea=0.154V) was added so that it would be the same molar amount as in Example 7. The results of the cooking are shown in Table 2. Like in Example 7, as compared with Comparative Examples 3 and 4, the Kappa number at the same active alkali addition decreased, and the yield of pulp at the same Kappa number increased.

Example 9

Cooking was carried out in the same manner as in Example 7 except that as a quinone compound, 2-methyl-9,10-anthraquinone (Ea=0.154V) was added so that it would be the same molar amount as in Example 7. The results of the cooking are shown in Table 2. Like in Example 7, as compared with Comparative Examples 3 and 4, the Kappa number at the same active alkali addition decreased, and the yield of pulp at the same Kappa number increased.

Example 10

Cooking was carried out in the same manner as in Example 7 except that as a quinone compound, 9,10-anthraquinone-2-sulfonic acid (Ea=0.187V) was added so that it would be the same molar amount as in Example 7. The results of the cooking are shown in Table 2. Like in Example 7, as compared with Comparative Examples 3 and 4, the Kappa number at the same active alkali addition decreased, and the yield of pulp at the same Kappa number increased.

Example 11

Cooking was carried out in the same manner as in Example 7 except that as a quinone compound, 1-hydroxy-9,10-anthraquinone (Ea=0.125V) was added so that it would be the same molar amount as in Example 7. The results of the cooking are shown in Table 2. Like in Example 7, as compared with Comparative Examples 3 and 4, the Kappa number at the same active alkali addition decreased, and the yield of pulp at the same Kappa number increased.

Example 12

Cooking was carried out in the same manner as in Example 7 except that as a quinone compound, disodium 9,10-anthraquinone-2,7-disulfonate (Ea=0.228V) was added so that it would be the same molar amount as in Example 7. The results of the cooking are shown in Table 2. Like in Example 7, as compared with Comparative Examples 3 and 4, the Kappa number at the same active alkali addition decreased, and the yield of pulp at the same Kappa number increased.

Comparative Example 3

Cooking was carried out in the same manner as in Example 7 except that the quinone compound or the like was not added. The results of the cooking are shown in Table 2.

Comparative Example 4

Cooking was carried out in the same manner as in Example 7 except that as a quinone compound, 1,2-dihydroxy-9,10-anthraquinone (Ea=0.107V) was added so that it would be the same molar amount as in Example 7. The results of the cooking are shown in Table 2.

TABLE 1

Cooking test using soft wood (Japanese red pine) chip

| Ex. No. and Comp. Ex. No. | Quinone compound | Standard oxidation-reduction potential (E0/V) | Active alkali addition = 16% Kappa number | Active alkali addition = 16% Yield of pulp (%) | Active alkali addition = 18% Kappa number | Active alkali addition = 18% Yield of pulp (%) | Yield of pulp (%) when the Kappa number = 22 |
|---|---|---|---|---|---|---|---|
| Ex. 1 | 9,10-anthraquinone | 0.154 | 27.2 | 49.2 | 20.8 | 48.3 | 48.8 |
| Ex. 2 | Tetrahydroanthraquinone | 0.154 | 25.4 | 49.2 | 20.3 | 48.4 | 49.0 |
| Ex. 3 | 2-methyl-9,10-anthraquinone | 0.154 | 25.0 | 48.5 | 20.8 | 47.8 | 48.4 |
| Ex. 4 | Sodium 9,10-anthraquinone-2-sulfonate | 0.187 | 29.5 | 49.0 | 23.0 | 48.1 | 48.2 |
| Ex. 5 | 1-hydroxy-9,10-anthraquinone | 0.125 | 30.4 | 49.0 | 23.9 | 48.1 | 48.1 |
| Ex. 6 | Disodium 9,10-anthraquinone-2,7-disulfonate | 0.228 | 30.7 | 49.1 | 24.2 | 48.1 | 48.1 |
| Comp. Ex. 1 | Not added | — | 32.3 | 48.6 | 25.0 | 47.2 | 46.9 |
| Comp. Ex. 2 | 1,2-dihydroxy-9,10-anthraquinone | 0.107 | 31.3 | 48.9 | 24.3 | 47.3 | 47.2 |

The active alkali addition is represented by wt % based on bone-dry chip, as calculated as $Na_2O$.

TABLE 2

Cooking test using hard wood (beech) chip

| Ex. No. and Comp. Ex. No. | Quinone compound | Standard oxidation-reduction potential (E0/V) | Active alkali addition = 16% Kappa number | Active alkali addition = 16% Yield of pulp (%) | Active alkali addition = 18% Kappa number | Active alkali addition = 18% Yield of pulp (%) | Yield of pulp (%) when the Kappa number = 18 |
|---|---|---|---|---|---|---|---|
| Ex. 7 | 9,10-anthraquinone | 0.154 | 18.7 | 57.7 | 14.2 | 55.9 | 57.6 |
| Ex. 8 | Tetrahydroanthraquinone | 0.154 | 17.9 | 57.7 | 13.6 | 56.1 | 57.8 |
| Ex. 9 | 2-methyl-9,10-anthraquinone | 0.154 | 20.2 | 57.8 | 13.6 | 55.7 | 57.4 |
| Ex. 10 | Sodium 9,10-anthraquinone-2-sulfonate | 0.187 | 23.4 | 58.3 | 15.3 | 55.8 | 57.1 |
| Ex. 11 | 1-hydroxy-9,10-anthraquinone | 0.125 | 24.5 | 57.9 | 16.6 | 55.9 | 56.5 |
| Ex. 12 | Disodium 9,10-anthraquinone-2,7-disulfonate | 0.228 | 27.0 | 58.1 | 17.3 | 55.9 | 56.1 |
| Comp. Ex. 3 | Not added | — | 29.3 | 57.5 | 18.1 | 55.3 | 55.3 |
| Comp. Ex. 4 | 1,2-dihydroxy-9,10-anthraquinone | 0.107 | 28.7 | 57.8 | 17.5 | 55.1 | 55.5 |

The active alkali addition is represented by wt % based on bone-dry chip, as calculated as $Na_2O$.

INDUSTRIAL APPLICABILITY

According to the present invention, by pulping by means of an alkaline cooking liquor containing polysulfides, in the presence of a quinone-hydroquinone compound having a standard oxidation-reduction potential within a certain specific range, it is possible to further improve the yield of pulp and further improve the relation between the Kappa number and the yield of pulp. Namely, not only excellent effects are obtainable to reduce the Kappa number at the same active alkali addition and to improve the yield of pulp at the same Kappa number, but also effects to reduce the amount of chemical solutions to be used and effects to reduce the load on the recovery boiler, can be accomplished.

The entire disclosure of Japanese Patent Application No. 11-168948 filed on Jun. 15, 1999 including specification, claims and summary are incorporated herein by reference in its entirety.

What is claimed is:

1. A method for cooking pulp, which comprises the step of:

a) pulping a lignocellulose material with an alkaline cooking liquor containing polysulfides in the presence of a quinone-hydroquinone compound, wherein the oxidation-reduction potential of the quinone-hydroquinone compound, in the form present during the cooking, is from about 0.12–0.25 V to the standard hydrogen electrode potential, wherein the potential is a value calculated as a standard oxidation-reduction potential (Ea) with a hydrogen ion activity of 1, and wherein the alkaline cooking liquor comprises polysulfide sulfur at a concentration of at least about 8 g/L, calculated as sulfur, and $Na_2S$-state sulfur at a concentration of at least about 10 g/l, calculated as $Na_2O$.

2. The method of claim 1, wherein the oxidation-reduction potential is from about 0.14–0.20 V to the standard hydrogen electrode potential.

3. The method of claim 1, wherein the alkaline cooking liquor during the cooking contains from about 0.01–1.5 wt. % of the quinone-hydroquinone compound based on bone-dry chip.

4. The method of claim 1, wherein a liquid to wood ratio of the cooking liquor during the cooking is from about 1.5–5.0 l/kg based on bone-dry chip.

5. The method of claim 1, wherein the quinone-hydroquinone compound comprises an alkyl anthraquinone, a quinone or hydroquinone compound.

6. The method of claim 5, wherein the alkyl anthraquinone comprises 1-ethyl-9,10-anthraquinone or 2-methyl-9,10-anthraquinone.

7. The method of claim 5, wherein the quinone compound comprises 1-hydroxy-9,10-anthraquinone, 2-(9,10-anthraquinoyl)-1-ethanesulfonic acid, 9,10-anthraquinone-2-sulfonic acid, 9,10-anthraquinone-2-carboxylic acid, 9,10-anthraquinone-2,7-disulfonic acid, benz (α) anthracene-7, 12-dion, 1,4,4a,9a-tetrahydro-9,10-anthraquinone, 1,4-dihydro-9,10-anthraquinone or the disodium salt of 1,4-dihydro-9,10-dihydroxyanthracene.

8. The method of claim 1, wherein the lignocellulose material comprises soft wood.

9. The method of claim 1, wherein the lignocellulose material comprises hard wood.

10. The method of claim 1, wherein the alkaline cooking liquor is prepared by electrolytically oxidizing an alkaline solution comprising sulfide ions.

11. An alkaline pulp cooking liquor composition, comprising:

a) polysulfide sulfur, at a concentration of at least about 8 g/L, calculated as sulfur; and b) one or more quinone-hydroquinone compounds having, in a form present during pulp cooking, an oxidation-reduction potential of about 0.12–0.25V to the standard hydrogen potential;

wherein the potential is calculated as a standard oxidation-reduction potential (Ea) with a hydrogen ion activity of 1, and c) $Na_2S$-state sulfur, at a concentration of at least about 10 g/l, calculated as $Na_2O$.

12. The composition of claim 11, wherein the oxidation-reduction potential is from about 0.14–0.20 V to the standard hydrogen electrode potential.

13. The composition of claim 11, wherein the alkaline cooking liquor is produced by electrolysis of white liquor or green liquor.

14. The composition of claim 11, wherein the alkaline cooking liquor during the cooking contains from about 0.01–1.5 wt. % of the quinone-hydroquinone compound based on bone-dry chip.

15. The composition of claim 11, wherein a liquid to wood ratio of the cooking liquor during the cooking is from about 1.5–5.0 l/kg based on bone-dry chip.

16. The composition of claim 11, wherein the quinone-hydroquinone compound comprises an alkyl anthraquinone, a quinone or hydroquinone compound.

17. The composition of claim 11, wherein the alkyl anthraquinone comprises 1-ethyl-9,10-anthraquinone or 2-methyl-9,10-anthraquinone.

18. The composition of claim 11, wherein the quinone compound comprises 1-hydroxy-9,10-anthraquinone, 2-(9,10-anthraquinoyl)-1-ethanesulfonic acid, 9,10-anthraquinone-2-sulfonic acid, 9,10-anthraquinone-2-carboxylic acid, 9,10-anthraquinone-2,7-disulfonic acid, benz (α) anthracene-7,12-dion, 1,4,4a,9a-tetrahydro- 9,10-anthraquinone, 1,4-dihydro-9,10-anthraquinone or disodium salt of 1,4-dihydro-9,10-dihydroxyanthracene.

19. The composition of claim 11, wherein the alkaline cooking liquor is prepared by electrolytically oxidizing an alkaline solution comprising sulfide ions.

20. A method for cooking pulp, which comprises the step of:

a) pulping a lignocellulose material with an alkaline cooking liquor containing polysulfides in the presence of a quinone-hydroquinone compound, wherein the oxidation-reduction potential of the quinone-hydroquinone compound, in the form present during the cooking, is from about 0.12–0.25 V to the standard hydrogen electrode potential, wherein the potential is a value calculated as a standard oxidation-reduction potential (Ea) with a hydrogen ion activity of 1, and wherein the alkaline cooking liquor comprises polysulfide sulfur at a concentration of at least about 8 g/L, calculated as sulfur, and $Na_2S$-state sulfur at a concentration of at least about 10 g/l, calculated as $Na_2O$, wherein the alkaline cooking liquor is produced by electrolysis of white liquor or green liquor.

21. The method of claim 20, wherein the oxidation-reduction potential is from about 0.14–0.20 V to the standard hydrogen electrode potential.

22. The method of claim 20, wherein the alkaline cooking liquor during the cooking contains from about 0.01–1.5 wt. % of the quinone-hydroquinone compound based on bone-dry chip.

23. The method of claim 20, wherein a liquid to wood ratio of the cooking liquor during the cooking is from about 1.5–5.0 l/kg based on bone-dry chip.

24. The method of claim 20, wherein the quinone-hydroquinone compound comprises an alkyl anthraquinone, a quinone or hydroquinone compound.

25. The method of claim 24, wherein the alkyl anthraquinone comprises 1-ethyl-9,10-anthraquinone or 2-methyl-9,10-anthraquinone.

26. The method of claim 24, wherein the quinone compound comprises 1-hydroxy-9,10-anthraquinone, 2-(9,10-anthraquinoyl)-1-ethanesulfonic acid, 9,10-anthraquinone-2-sulfonic acid, 9,10-anthraquinone-2-carboxylic acid, 9,10-anthraquinone-2,7-disulfonic acid, benz (α) anthracene-7,12-dion, 1,4,4a,9a-tetrahydro-9,10-anthraquinone, 1,4-dihydro-9,10-anthraquinone or the disodium salt of 1,4-dihydro-9,10-dihydroxyanthracene.

27. The method of claim 20, wherein the lignocellulose material comprises soft wood.

28. The method of claim 20, wherein the lignocellulose material comprises hard wood.

29. The method of claim 20, wherein the alkaline cooking liquor is prepared by electrolytically oxidizing an alkaline solution comprising sulfide ions.

30. An alkaline pulp cooking liquor composition produced by electrolysis of white liquor or green liquor, comprising:

a) polysulfide sulfur, at a concentration of at least about 8 g/L, calculated as sulfur; and b) one or more quinone-hydroquinone compounds having, in a form present during pulp cooking, an oxidation-reduction potential of about 0.12–0.25V to the standard hydrogen potential;

wherein the potential is calculated as a standard oxidation-reduction potential (Ea) with a hydrogen ion activity of 1, and c) $Na_2S$-state sulfur, at a concentration of at least about 10 g/l, calculated as $Na_2O$.

31. The composition of claim 30, wherein the oxidation-reduction potential is from about 0.14–0.20 V to the standard hydrogen electrode potential.

32. The composition of claim 30, wherein the alkaline cooking liquor during the cooking contains from about 0.01–1.5 wt. % of the quinone-hydroquinone compound based on bone-dry chip.

33. The composition of claim 30, wherein a liquid to wood ratio of the cooking liquor during the cooking is from about 1.5–5.0 l/kg based on bone-dry chip.

34. The composition of claim 30, wherein the quinone-hydroquinone compound comprises an alkyl anthraquinone, a quinone or hydroquinone compound.

35. The composition of claim 30, wherein the alkyl anthraquinone comprises 1-ethyl-9,10-anthraquinone or 2-methyl-9,10-anthraquinone.

36. The composition of claim 30, wherein the quinone compound comprises 1-hydroxy-9,10-anthraquinone, 2-(9,10-anthraquinoyl)-1-ethanesulfonic acid, 9,10-anthraquinone-2-sulfonic acid, 9,10-anthraquinone-2-carboxylic acid, 9,10-anthraquinone-2,7-disulfonic acid, benz (α) anthracene-7,12-dion, 1,4,4a,9a-tetrahydro-9,10-anthraquinone, 1,4-dihydro-9,10-anthraquinone or disodium salt of 1,4-dihydro-9,10-dihydroxyanthracene.

37. The composition of claim 30, wherein the alkaline cooking liquor is prepared by electrolytically oxidizing an alkaline solution comprising sulfide ions.

* * * * *